United States Patent [19]

Kawamura

[11] Patent Number: 4,938,179

[45] Date of Patent: Jul. 3, 1990

[54] VALVE CONTROL SYSTEM FOR INTERNAL COMBUSTION ENGINE

[75] Inventor: Hideo Kawamura, Samukawa, Japan

[73] Assignee: Isuzu Motors Limited, Tokyo, Japan

[21] Appl. No.: 446,101

[22] Filed: Dec. 5, 1989

[30] Foreign Application Priority Data

Dec. 28, 1988 [JP] Japan ..... 63-334963

[51] Int. Cl.[5] ..... F01L 9/04; F01N 7/00

[52] U.S. Cl. ..... 123/90.11; 60/324

[58] Field of Search ..... 123/90.11, 90.15; 60/324, 312

[56] References Cited

U.S. PATENT DOCUMENTS

| | | | |
|---|---|---|---|
| 3,682,152 | 8/1972 | Muller-Berner | 123/90.11 |
| 3,938,330 | 2/1976 | Nakajima et al. | 60/324 |
| 4,544,986 | 10/1985 | Buchl | 123/90.11 |
| 4,614,170 | 9/1986 | Pischinger et al. | 123/90.11 |
| 4,665,692 | 5/1987 | Inaba | 60/324 |
| 4,707,987 | 11/1987 | Atkin | 60/324 |
| 4,715,332 | 12/1987 | Kreuter | 123/90.11 |
| 4,779,582 | 10/1988 | Lequesne | 123/90.11 |

*Primary Examiner*—David A. Okonsky
*Assistant Examiner*—Weilun Lo
*Attorney, Agent, or Firm*—Staas & Halsey

[57] ABSTRACT

A valve control system for controlling intake and exhaust valves of an internal combustion engine associated with an exhaust brake includes electromagnetic actuator means for electromagnetically operating the intake and exhaust valves. When the exhaust brake is applied, the electromagnetic actuator means is operated to increase the force to close the exhaust valve of the cylinder in the intake stroke. With the exhaust valve thus securely closed, the back pressure of exhaust gases on the engine can be increased thereby to increase the power of the engine brake being applied.

7 Claims, 2 Drawing Sheets

VALVE CONTROL SYSTEM FOR INTERNAL COMBUSTION ENGINE

BACKGROUND OF THE INVENTION

1. Field of the Invention

The present invention relates to a valve control system for electromagnetically actuating intake and exhaust valves of an internal combustion engine, and more particularly to a valve control system for controlling an exhaust valve when an exhaust brake is applied.

2. Description of the Related Art

Diesel engines are generally associated with an exhaust brake as a means for increasing the power of an engine brake. The exhaust brake includes an exhaust brake valve disposed in an exhaust pipe extending from the engine. When the motor vehicle with the exhaust brake runs downhill on a long sloping road, the exhaust brake valve is closed to close the exhaust pipe for thereby increasing the back pressure of exhaust gases on the engine, so that the friction loss in the exhaust stroke is increased for an increased engine brake power. If the back pressure on the engine exceeds a certain level at the time the exhaust brake valve is closed, however, the exhaust valve of the engine cylinder which is in the intake stroke is forcibly opened under the back pressure against the bias of the valve spring of the exhaust valve, thus allowing engine exhaust gases to flow back into the engine cylinder. Therefore, the back pressure on the engine should not be increased beyond the predetermined pressure level. The engine brake power is thus governed by the force of the exhaust valve spring. In order to further increase the engine brake power produced by the exhaust brake, the spring bias of the exhaust valve spring may be increased. If the spring force of the exhaust valve spring is increased, however, undue stresses will be imposed on the mechanism for operating the valves of the engine, and the cams and rocker arms will be worn prematurely.

Electromagnetic valve control systems for controlling the intake and exhaust valves of engines through an electromagnetic actuator means, rather than mechanical drive means, are disclosed in Japanese Laid-Open Patent Publication Nos. 58(1983)-183805 and 61(1986)-76713. These publications only show the operation of the intake and exhaust valves with the electromagnetic drive means.

SUMMARY OF THE INVENTION

It is an object of the present invention to provide a valve control system for an internal combustion engine, which includes an electromagnetic actuator means for electromagnetically operating the intake and exhaust valves of the internal combustion engine that is associated with an exhaust brake, the electromagnetic actuator means being operable to increase the force to close the exhaust valve of the engine cylinder which is in the intake stroke when the exhaust brake is operated, so that the back pressure of exhaust gases imposed on the engine when the exhaust brake is in operation can be increased for thereby increasing the engine brake power.

According to the present invention, there is provided a valve control system for controlling intake and exhaust valves of each of the cylinders of an internal combustion engine which is associated with an exhaust brake having an exhaust brake valve disposed in an exhaust pipe from the internal combustion engine, the valve control system comprising electromagnetic actuator means for opening and closing the intake and exhaust valves, the electromagnetic actuator means being associated with the intake and exhaust valves, respectively, a crankshaft angle sensor for detecting the angular position of the crankshaft of the internal combustion engine, timing calculating means for calculating the timing at which the intake and exhaust valves are to be opened and closed, based on a detected signal from the crankshaft angle sensor, operation control means for applying drive signals to the electromagnetic actuator means based on the timing calculated by the timing calculating means, exhaust brake operation detecting means for detecting operation of the exhaust brake, and electric power control means responsive to a detected signal from the exhaust brake operation detecting means for controlling electric power to be supplied to the electromagnetic actuator means associated with the exhaust valve of the cylinder in an intake stroke, to increase a force to keep the exhaust valve closed while the exhaust brake is being applied.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
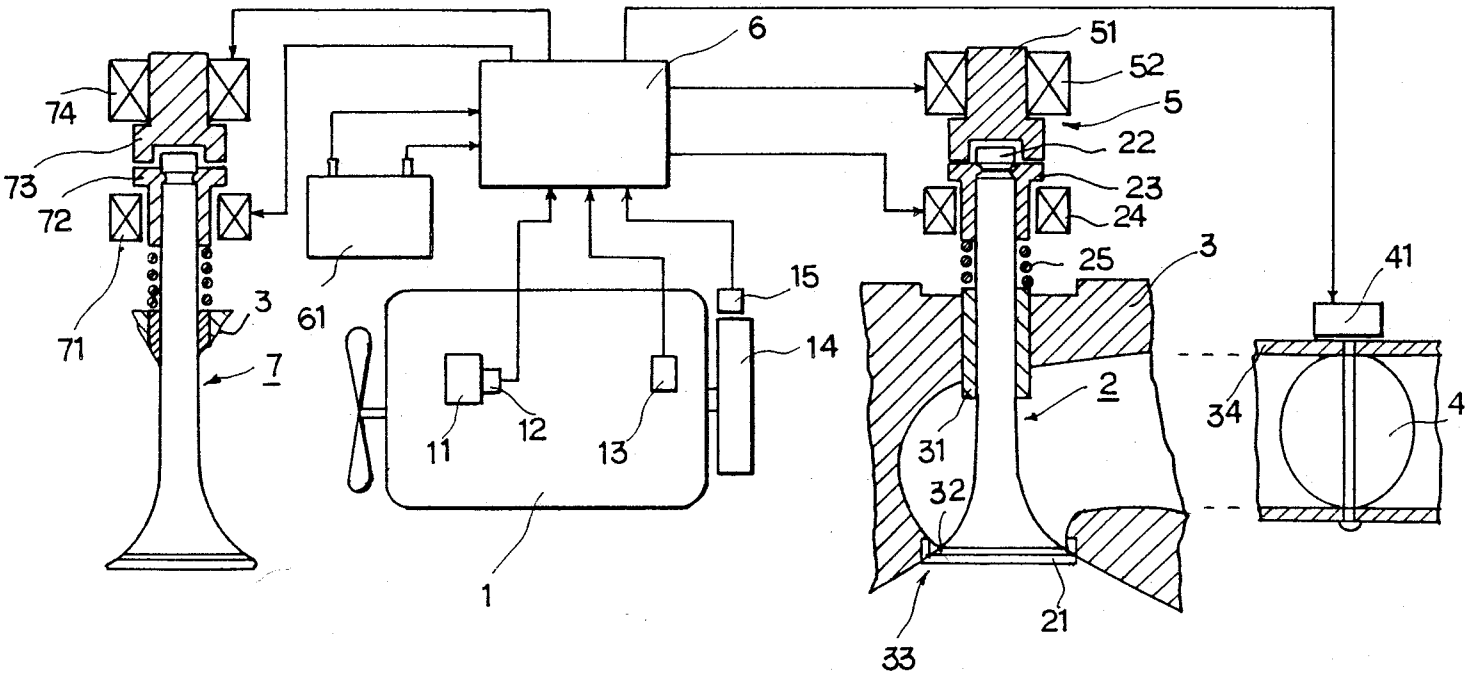
FIG. 1 is a schematic diagram, partly in cross section, of a valve control system for an internal combustion engine according to the present invention.

FIG. 1 shows a valve control system for an internal combustion engine according to the present invention.

As shown in FIG. 1, an internal combustion engine 1 is mounted on a motor vehicle (not shown) for driving the motor vehicle. The internal combustion engine 1 is supplied with fuel from a fuel supply unit 11 such as a fuel injection pump. The amount of fuel supplied to the internal combustion engine 1 by the fuel supply unit 11 is detected by an engine load sensor 12, which applies a detected signal to a controller 6. The top dead center of the piston in each of the cylinders of the internal combustion engine 1 and the angular position of the crankshaft of the engine 1 are detected by a crankshaft angle sensor 13. An engine speed sensor 15 for detecting the rotational speed of the engine 1 is positioned in confronting relation to a flywheel 14 of the engine 1. Detected signals from the sensors 13, 15 are also sent to the controller 6.

An exhaust valve 2 in each cylinder of the internal combustion engine 1 is made of a ceramic material such as silicon nitride, silicon carbide, or the like, and is slidably fitted in a valve guide sleeve 31 mounted in a cylinder head 3 and made of a ceramic material such as silicon nitride, silicon carbide, or the like. The exhaust valve 2 includes a valve head 21 which can be seated on and unseated from a valve seat 32 to open and close an exhaust port 33 for thereby controlling the stream of exhaust gases from the engine cylinder. A movable member 23 of a magnetic material such as soft steel is fixedly fitted over the upper end 22 of the stem of the exhaust valve 2. A lower coil 24 is disposed around the movable member 23. When the lower coil 24 is energized, it magnetically moves the movable member 23 in the axial direction of the exhaust valve 2. An electromagnet 5 is disposed in confronting relation to the movable member 23. The electromagnet 5 comprises a fixed member 51 made of a magnetic material such as soft steel and an upper coil 52 fixed to and disposed around the fixed member 51. The movable member 23, the lower coil 24, the fixed member 51, and the upper coil 52 jointly serve as an electromagnetic actuator means for electromagnetically actuating the exhaust valve 2. By supplying electric power to the coils 24, 52 and controlling the polarity and voltage of the supplied electric power, the electromagnetic actuator means controls the opening and closing of the exhaust valve 2 and the intensity of forces to open and close the exhaust valve 2. A coil spring 25 is disposed around the valve stem between the movable member 23 and the valve guide sleeve 31 for normally urging the exhaust valve 2 to close the exhaust port 33 and prevent the exhaust valve 2 from dropping when the coils 24, 52 are deenergized.

An exhaust brake valve 4 is disposed in an exhaust pipe 34 connected to the exhaust port 33. When an exhaust brake switch (not shown) disposed in the driver's compartment of the motor vehicle is separated, the exhaust brake valve 4 is closed by an exhaust valve control unit 41 to close the exhaust pipe 34 for thereby increasing the back pressure on the engine. The exhaust valve control unit 41 also serves as a detector for detecting whether the exhaust brake valve 4 is opened or closed, and supplying the controller 6 with a signal indicative of whether the exhaust brake is operated or not. However, a signal indicating whether the exhaust brake is operated or not may be derived from the signal produced by the exhaust brake switch.

The controller 6 includes a central processing unit for effecting various arithmetic operations based on a control program, memories for storing the control program, various data, etc., and an input/output interface. When the controller 6 is supplied with signals from the sensors 12, 13, 15 and the exhaust valve control unit 41, the controller 6 processes the supplied signals according to the control program, controls the polarity and voltage of electric power from a battery 61, and supplies the controlled electric power to the coils 24, 52 which electromagnetically controls the exhaust valve 2 to open or close the exhaust port 33.

An intake valve 7 in each cylinder of the internal combustion engine 1 is made of a ceramic material such as silicon nitride, silicon carbide, or the like, and is slidably fitted in a valve guide sleeve mounted in a cylinder head 3 and made of a ceramic material such as silicon nitride, silicon carbide, or the like. A movable member 72 of a magnetic material such as soft steel is fixedly fitted over the upper end of the stem of the intake valve 7. A lower coil 71 is disposed around the movable member 72. When the lower coil 71 is energized, it magnetically moves the movable member 72 in the axial direction of the intake valve 7. An electromagnet disposed in confronting relation to the movable member 72 comprises a fixed member 73 made of a magnetic material such as soft steel and an upper coil 74 fixed to and disposed around the fixed member 73. The movable member 72, the lower coil 71, the fixed member 73, and the upper coil 74 jointly serve as an electromagnetic actuator means for electromagnetically actuating the intake valve 7. Electric power supplied to the coils 71, 74 is controlled by the controller 6 to open and close the intake valve 7.

Figure 2:
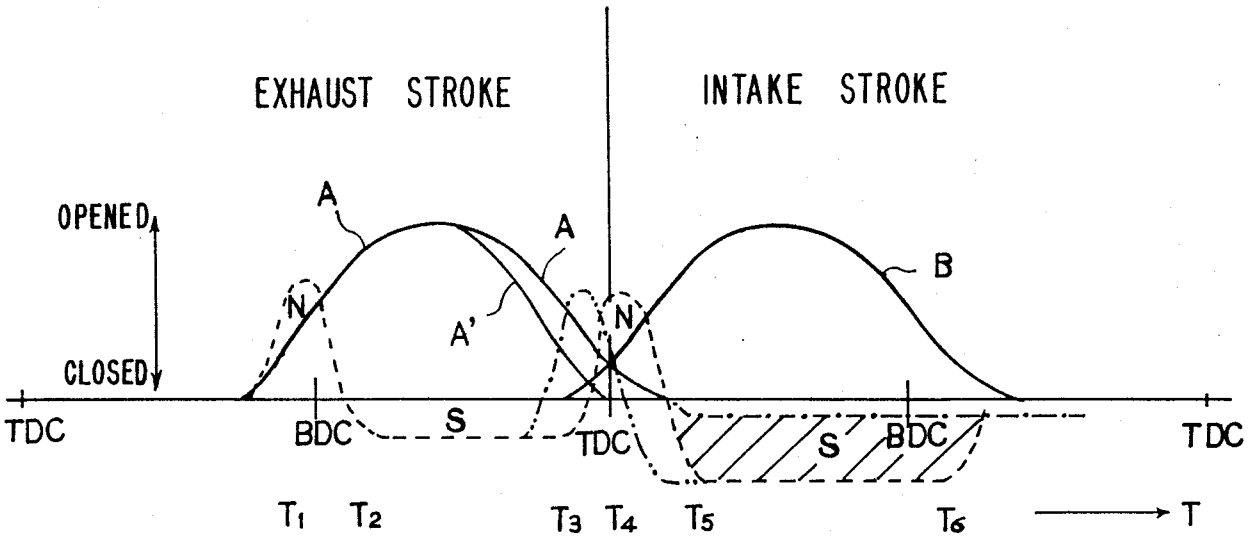
FIG. 2 is a graph illustrative of the timing of opening and closing intake and exhaust valves and the timing of energization of electromagnetic actuator means of the valve control system.

FIG. 2 shows the timing of opening and closing the exhaust valve 2 and the intake valve 7 and also the timing of energizing the coils of the electromagnetic actuator means.

In FIG. 2, the curve A represents the operation of the exhaust valve 2, and the curve B represents the operation of the intake valve 7. The vertical axis of the graph of FIG. 2 indicates the degree to which the valves are opened or closed. The broken-line curves indicate the intensity of an electric current supplied to the coil 24 when the magnetic polarity of the lower surface of the fixed member 51 is N pole, and also the magnetic polarity of the upper surface of the movable member 23.

Operation of the valve control system will be described below with reference to FIG. 2.

In order to open the exhaust valve 2 at a time T1 to start the exhaust stroke of the piston, the controller 6 processes the signals from the crankshaft angle sensor 3 and the engine speed sensor 4, and energizes the coils 24, 52 at a predetermined crankshaft angle in advance of the bottom dead center (BDC) of the piston to magnetize the movable and fixed members 23 and 51, respectively such that the lower surface of the fixed member 51 is magnetized as N pole and the upper surface of the movable member 23 as N pole. Therefore, the movable member 23 is magnetically repelled from the fixed member 51, thereby starting to open the exhaust valve 2. Then, the controller 6 energizes the coil 24 with a weak current of the opposite polarity such that the upper surface of the movable member 23 is magnetized as S pole from a time T2 to a time T3. From the time T3 to a time T4, the controller 6 supplies the coil 24 with a weak current such that the upper surface of the movable member 23 is magnetized as N pole again in order to lessen shocks produced when the exhaust valve 2 is seated on the valve seat. The exhaust valve 2 is fully closed at a time T5 corresponding to a predetermined crankshaft angle after the top dead center (TDC).

When a predetermined crankshaft angle is reached in advance of the top dead center (TDC), the controller 6 energizes the coils 74, 71 to open and close the intake valve 7 according to a pattern indicated by the curve B, in a manner similar to the above control to open and close the exhaust valve 2.

If the controller 6 determines from the signal of the exhaust valve control unit 41 that the exhaust brake valve 4 is closed and hence the exhaust brake is applied during the intake stroke, then the controller 6 supplies a strong current to the coil 24 in such a direction that the upper surface of the movable member 23 is magnetized as S pole. Thus, the movable member 23 is strongly attracted to the N pole of the lower surface of the fixed member 51 for increasing the force with which the exhaust valve 2 remains closed. Since the exhaust valve 2 remains closed with the strong force even in the intake stroke while the exhaust brake is being applied, the exhaust valve 2 is prevented from being opened under the high back pressure of exhaust gases and hence remains closed securely even when the pressure in the cylinder is lowered in the intake stroke.

The two-dot-and-dash-line curve at the time T3 in FIG. 2 shows the timing to energize the coil 24 to close the exhaust valve 2 earlier according to the curve A'.

The above operation of the valve control system is effected when the exhaust brake switch is turned on and the exhaust valve control unit 41 has supplied the controller 6 with a signal indicating that the exhaust brake valve 4 is closed and the exhaust brake is being applied. When the exhaust brake switch is not turned on, the energization of the coil 24 is controlled as indicated by the dot-and-dash-line curve segment from the time T5 to a time T6. The broken line curve segment corresponds to the case where the brake switch is turned on. The hatched area between the times T5 and T6 and between the broken line and dot-and-dash-line curve segments represents the amount of electric power which is supplied to the coil 24 to increase the force to keep the exhaust valve 2 closed while the exhaust brake is being applied.

With the embodiment of the present invention, when the exhaust brake switch is turned on and the exhaust brake valve 4 is closed, the electric power supplied to the electromagnetic actuator means for the exhaust valve 2 of the cylinder in the intake stroke is controlled to increase the force to keep the exhaust valve 2 closed. Therefore, even if the pressure in the cylinder is lowered in the intake stroke, the exhaust valve 2 remains firmly closed even under the high back pressure of exhaust gases acting on the exhaust valve 2. Consequently, the back pressure of exhaust gases imposed on the engine during operation of the exhaust brake can sufficiently be increased, and hence the power of the engine brake can be increased.

Furthermore, since the intake and exhaust valves are made of a ceramic material, they are lighter than metal valves, and can operate smoothly as inertial forces applied thereto are small. In addition, the intake and exhaust valves may be driven by smaller drive forces generated by the electromagnetic actuator means.

Although a certain preferred embodiment has been shown and described, it should be understood that many changes and modifications may be made therein without departing from the scope of the appended claims.

What is claimed is:

1. A valve control system for controlling intake and exhaust valves of each of the cylinders of an internal combustion engine which includes a crankshaft and an exhaust brake having an exhaust brake valve disposed in an exhaust pipe of the internal combustion engine, said valve control system comprising:

electromagnetic actuator means, associated with each of the intake and exhaust valves, for opening and closing the intake and exhaust valves;

a crankshaft angle sensor for detecting and outputting a signal indicative of an angular position of the crankshaft of the internal combustion engine;

timing calculating means for calculating the timing at which the intake and exhaust valves are to be opened and closed, based on the detected signal from said crankshaft angle sensor;

operation control means for applying drive signals to said electromagnetic actuator means based on the timing calculated by said timing calculating means;

exhaust brake operation detecting means for detecting and outputting a signal indicative of operation of the exhaust brake; and electric power control means responsive to the detected signal from said exhaust brake operation detecting means for controlling electric power to be supplied to said electromagnetic actuator means associated with said exhaust valve of the cylinder in an intake stroke, to increase a force to keep the exhaust valve closed while the exhaust brake is being applied.

2. A valve control system according to claim 1, wherein said electromagnetic actuator means associated with each of the intake and exhaust valves comprises a movable member of a magnetic material mounted on an upper end of the stem of the valve, a first coil disposed around said movable member, a fixed member of a magnetic material disposed in confronting relation to said movable member, and a second coil disposed around said fixed member.

3. A valve control system according to claim 1, wherein the intake and exhaust valves are made of a ceramic material.

4. A valve control system according to claim 1, wherein the movable member and the fixed member have opposing end faces which are selectively polarized by current of varying intensity delivered to the electromagnetic actuator means by the electric power control means.

5. A valve control system according to claim 4, wherein movement is imparted in the intake and exhaust valves by magnetic repulsion and attraction between the end faces of the movable member and the fixed members.

6. A valve control system according to claim 5, wherein the forces to keep the exhaust valve closed is the magnetic attraction between the opposing end faces of the movable member and the fixed member.

7. A valve control system according to claim 6, wherein the opposing surface of the fixed member has a polarity and the opposing surface of the movable member has an opposite polarity derived from an electric current the intensity of which is increased when the exhaust brake is operating.

* * * * *